US010077482B2

(12) United States Patent
Park et al.

(10) Patent No.: US 10,077,482 B2
(45) Date of Patent: Sep. 18, 2018

(54) MOLTEN IRON REFINING METHOD AND DEVICE THEREOF

(71) Applicant: POSCO, Pohang-Si (KR)

(72) Inventors: Jung Ho Park, Gwangyang-Si (KR); Soo Chang Kang, Gwangyang-Si (KR); Jin Kyu Chun, Jinju-Si (KR); Yun Yeol Seo, Gwangyang-Si (KR)

(73) Assignee: POSCO, Gyeongsangbuk-Do (KR)

( * ) Notice: Subject to any disclaimer, the term of this patent is extended or adjusted under 35 U.S.C. 154(b) by 258 days.

(21) Appl. No.: 14/910,771

(22) PCT Filed: Sep. 25, 2013

(86) PCT No.: PCT/KR2013/008535
§ 371 (c)(1),
(2) Date: Feb. 8, 2016

(87) PCT Pub. No.: WO2015/020262
PCT Pub. Date: Feb. 12, 2015

(65) Prior Publication Data

US 2016/0186277 A1 Jun. 30, 2016

(30) Foreign Application Priority Data

Aug. 7, 2013 (KR) ..... 10-2013-0093720

(51) Int. Cl.
*C21C 1/02* (2006.01)
*C21C 1/06* (2006.01)
(Continued)

(52) U.S. Cl.
CPC ..... *C21C 1/02* (2013.01); *C21C 1/025* (2013.01); *C21C 1/06* (2013.01); *C21C 7/0075* (2013.01);
(Continued)

(58) Field of Classification Search
CPC ..... C22B 9/103; C21C 1/02; C21C 7/064; C21C 1/06; C21C 7/0645; F27D 27/00; F27D 3/16
See application file for complete search history.

(56) References Cited

U.S. PATENT DOCUMENTS 4,240,618 A * 12/1980 Ostberg ..... B01F 3/04539 266/235
4,282,032 A 8/1981 Nagoya et al.
(Continued)

FOREIGN PATENT DOCUMENTS

CN 102424879 4/2012
CN 202380011 8/2012
(Continued)

OTHER PUBLICATIONS

JP 59093814-A machine translation (Year: 1984).*
(Continued)

*Primary Examiner* — George Wyszomierski
*Assistant Examiner* — Tima M McGuthry-Banks
(74) *Attorney, Agent, or Firm* — Cantor Colburn LLP

(57) ABSTRACT

Provided are a molten metal refining device and method. The molten metal refining method includes: preparing molten metal; dipping an impeller into the molten metal; supplying a liquid dephosphorization agent on top of the molten metal; and stirring the molten metal by rotating the impeller, wherein a solid dephosphorization agent in a powder state is supplied through the lower portion of the impeller in the stirring of the molten metal, thereby improving the stirring efficiency of the molten metal and efficiently controlling the phosphorus concentration in the molten metal.

15 Claims, 9 Drawing Sheets

(51) Int. Cl.

| | |
|---|---|
| ***C21C 7/064*** | (2006.01) |
| ***C22B 9/10*** | (2006.01) |
| ***F27D 27/00*** | (2010.01) |
| ***F27D 3/16*** | (2006.01) |
| ***C21C 7/00*** | (2006.01) |

(52) U.S. Cl.

CPC ..... *C21C 7/064* (2013.01); *C21C 7/0645* (2013.01); *C22B 9/103* (2013.01); *F27D 3/16* (2013.01); *F27D 27/00* (2013.01)

(56) References Cited

U.S. PATENT DOCUMENTS

| | | | |
|---|---|---|---|
| 4,363,657 | A | 12/1982 | Boscaro et al. |
| 4,662,937 | A | 5/1987 | Katayama et al. |
| 4,684,403 | A | 8/1987 | Lee et al. |
| 4,752,327 | A | 6/1988 | Lee et al. |
| 6,299,828 | B1 | 10/2001 | Eckert |

FOREIGN PATENT DOCUMENTS

| | | | | |
|---|---|---|---|---|
| CN | 102719588 | | | 10/2012 |
| JP | 47051681 | | | 12/1972 |
| JP | 491967 | | | 1/1974 |
| JP | 52077910 | | | 12/1975 |
| JP | 57073107 | A | * | 5/1982 |
| JP | 57098617 | A | * | 6/1982 |
| JP | 57152406 | | | 9/1982 |
| JP | 59070706 | | | 4/1984 |
| JP | 59093814 | | | 5/1984 |
| JP | 59093814 | A | * | 5/1984 |
| JP | 60200904 | A | * | 10/1985 |
| JP | 61199011 | | | 9/1986 |
| JP | 62067148 | | | 3/1987 |
| JP | 04297516 | | | 10/1992 |
| JP | 07331313 | | | 12/1995 |
| JP | 2001064713 | A | * | 3/2001 |
| JP | 2003119509 | | | 4/2003 |
| JP | 2005068506 | | | 3/2005 |
| JP | 2006161079 | | | 6/2006 |
| JP | 2007092158 | | | 4/2007 |
| JP | 2007113042 | | | 5/2007 |
| JP | 2007277669 | | | 10/2007 |
| JP | 2009114506 | | | 5/2009 |
| JP | 2010116612 | | | 5/2010 |
| JP | 2010185114 | | | 8/2010 |
| KR | 1020040053602 | | | 6/2004 |
| KR | 1020100076116 | | | 7/2010 |
| KR | 1020120028761 | | | 3/2012 |
| KR | 101218923 | | | 1/2013 |
| SU | 539947 | A | * | 2/1976 |
| WO | WO-2004013358 | A1 | * | 2/2004 ..... C21C 1/02 |

OTHER PUBLICATIONS

SU 539947-A machine translation (Year: 1976).*
WO 2004-013358-A (Year: 2004).*
JP 2001-064713-A (Year: 2001).*
JP 60200904-A machine translation (Year: 1985).*
JP 57098617-A machine translation (Year: 1982).*
JP 57073107-A machine translation (Year: 1982).*
JP 2005-068506 machine translation (Year: 2005).*
International Search Report—PCT/KR2013/008535 dated Apr. 28, 2014.
PCT Written Opinion—PCT/KR2013/008535 dated Apr. 28, 2014, citing JP 2005-068506, JP 2007-277669, JP 2003-119509, JP 2010-116612 and KR 10-2004-0053602.
Japanese Office Action—Japanese Application No. 2016-532999 dated Nov. 14, 2017, citing JP 2005-068506, JP 61-199011, JP 47-51681, JP 2007-113042, JP 59-93814, JP 2009-114506, JP 04-297516 AND JP 07-331313.
European Search Report—European Application No. 13891083.1, dated Mar. 3, 2017, citing JP 2005 068506, CN 202 380 011, JP 2009 114506 and U.S. Pat. No. 6,299,828.
Japanese Office Action—Japanese Application No. 2016-532999 dated May 21, 2018, citing JP 2005-068506, JP 61-199011, JP 47-51681, JP 2007-113042, JP 59-93814, JP 04-297516, JP 07-331313, JP 59-70706 and JP 49-1967.

* cited by examiner

MOLTEN IRON REFINING METHOD AND DEVICE THEREOF

TECHNICAL FIELD

The present invention relates to a molten metal refining method and device, and more particularly, to a molten metal refining method and device which is capable of efficiently controlling the phosphorus concentration in ferromanganese molten metal.

BACKGROUND ART

In general, since phosphorus (P) is present as an impurity in steel and degrades the quality of a steel product, for example, causes high temperature brittleness, the phosphorus (P) concentration in steel is preferably reduced except for a special case. Accordingly, a dephosphorization operation for removing phosphorus (P) in ferromanganese molten metal is performed.

In a typical dephosphorization operation for manufacturing ferromanganese, molten metal is charged into a ladle, an impeller is then dipped into the molten metal, and then the molten metal is stirred. Here, as illustrated in FIG. 12, a typical impeller 20 includes an impeller body 21 extending in the vertical direction, a plurality of blades 22 connected to a lower outer circumferential surface of the impeller body 21, blowing nozzles 23 formed to pass through each of the plurality of blades 22, a supply tube 24 formed to pass through the inner center of the impeller body 21 and the blades 22 and supplying a dephosphorization agent and gas to the blowing nozzles 23, and a flange 25 connected to the upper end of the impeller body 21. The flange 25 is also connected to a drive part (not shown) supplying rotational power.

A stirring flow according to the operation of this impeller 20 will be simply described as follows. As illustrated in FIG. 12, the stirring flow (solid arrow) generated by the rotation of the blades 22 is generated in the direction toward the inner wall of the ladle 10, collides then with the inner wall, and then flows to be separated into upward and downward directions along the inner wall of the ladle 10. However, a flow of the dephosphorization agent and the gas, which are discharged from the blowing nozzle 23, the flow ascending along the outer circumferences of the blades 22 and the impeller body 21, collides with a flow which collides with the inner wall of the ladle 10 by the rotation of the blades 22, then ascends, and then descends. Also, a flow of the dephosphorization agent and the gas, the flow ascending along the outer circumferences of the blades 22 and the impeller body 21, and descending then along the inner wall of the ladle 10, collides with a stirring flow which is generated by the rotation of the blades 22, and ascends along the inner wall of the ladle 10. Stirring force is cancelled by these collisions of the flows. Accordingly, the reaction rate between the molten metal and the dephosphorization agent is decreased and cause a decrease in a dephosphorization rate.

Thus, there are limitations in that it is not easy for an operator to remove phosphorus (P) up to a desired phosphorus concentration, and it takes a long time to remove phosphorus (P) up to a target value.

Also, there are limitations in that since a solid phase dephosphorization agent at room temperature is inputted into the molten metal, the temperature of the molten metal is decreased to thereby decrease a dephosphorization effect and a temperature-raising process to increase the temperature of the molten metal is required in a subsequent process.

DISCLOSURE OF THE INVENTION

Technical Problem

In order to address the foregoing problems, the present invention provides a molten metal refining method and device which is capable of improving dispersion performance of dephosphorization agents introduced into the molten metal by improving the stirring efficiency of the molten metal.

The present invention also provides a molten metal refining method and device which is capable of efficiently controlling the phosphorus (P) concentration in the molten metal.

The present invention also provides a molten metal refining method and device which is capable of increasing the dephosphorization efficiency by suppressing the decrease in the temperature of the molten metal.

Technical Solution

In accordance with an exemplary embodiment, a molten metal refining device for refining molten metal, includes: an impeller extending in a vertical direction over a ladle in which the molten metal is charged; and a liquid dephosphorization agent supply part disposed over the ladle to supply a molten state liquid dephosphorization agent to a top portion of the molten metal, wherein the impeller comprises: an impeller body; blades provided on an upper outer circumferential surface of the impeller body; a supply pipe which is disposed inside the impeller body along a lengthwise direction of the impeller body and through which a solid dephosphorization agent in a powder state and a transfer gas are supplied; and blowing nozzles partially passing through a lower portion of the impeller body and communicating with the supply pipe.

The blades may be positioned above approximately the midpoint of a total depth of the molten metal, and the blowing nozzles may be positioned under approximately the midpoint of the total depth of the molten metal.

The blades may be disposed in a region of approximately 10% to approximately 30% with respect to a total depth of the molten metal from a molten metal surface of the molten metal.

The liquid dephosphorization agent supply part may be connected to a discharge pipe provided with a heater to heat the liquid dephosphorization agent.

The blades may have upper widths formed greater than lower widths.

The upper widths of the blades may be formed greater than the lower widths of the blades by approximately 5% to approximately 20% of total lengths of the upper widths.

The blades may be formed to have widths of approximately 35% to approximately 45% to an inner diameter of the ladle.

The blades may be provided in plurality and spaced apart from each other about the impeller main body, and inclined surfaces may be formed on at least one side surface facing an adjacent blade.

The one side surface of the blade may be formed to have an angle of approximately 10° to approximately 30° with respect to an upper surface of the blade.

In accordance with an exemplary embodiment, a method of refining molten metal includes: preparing molten metal;

dipping an impeller into the molten metal; supplying a liquid dephosphorization agent to an upper portion of the molten metal; and stirring the molten metal by rotating the impeller, wherein a solid dephosphorization agent in a powder state is supplied through a lower portion of the impeller during the stirring of the molten metal.

Slag generated from a previous process may be removed before the dipping of the impeller.

In the dipping of the impeller, blades of the impeller may be disposed above approximately the midpoint of a total depth of the molten metal, and blowing nozzles of the impeller may be disposed under approximately the midpoint of the total depth of the molten metal.

The blades of the impeller may be disposed in a region of approximately 10% to approximately 30% from a molten metal surface of the molten metal.

The stirring may include stirring the molten metal such that a direction of a stirring flow of the molten metal generated from blades of the impeller coincides with a direction of a stirring flow of the molten metal generated by the solid dephosphorization agent blown into the molten metal.

The stirring flow generated from the blades may flow to be separated into upward and downward directions, and an area of the stirring flow of the molten metal in the downward direction from the blades may be greater than an area of the stirring flow of the molten metal in the upward direction from the blades.

The liquid dephosphorization agent supplied to the molten metal may be approximately 50 wt % to approximately 70 wt % with respect to a total weight of the liquid and solid dephosphorization agents.

In the supplying of the solid dephosphorization agent, an inert gas may be supplied together with the solid dephosphorization agent.

The slag may be removed after the stirring of the molten metal.

Advantageous Effects

A molten metal refining method and device according to an embodiment of the present invention may improve the dephosphorization efficiency by improving the dispersion performance of dephosphorization agents which are introduced into the molten metal by providing blades and blowing nozzles to be separated from each other, respectively to upper and lower portions of molten metal. That is, a liquid dephosphorization agent is introduced to an upper portion of the molten metal received in a ladle, the molten metal is stirred by using an impeller including the blades disposed in the upper portion of the molten metal, and a solid dephosphorization agent and a transfer gas are injected through blowing nozzles in a lower portion of the impeller, so that a stirring flow generated by the blades and a stirring flow by substances blown into molten metal through the blowing nozzles coincide with each other and the two flows are integrated with each other to thereby improve the overall stirring power. Thus, the efficiency of stirring by using the impeller is improved in comparison with related arts, the reaction rate between the molten metal and the dephosphorization agents is thereby increased, and thus the refining efficiency is improved.

Also, the decrease in the temperature of the molten metal is suppressed by the introduction of the liquid dephosphorization agent, and thus the dephosphorization efficiency may be further improved.

MODE FOR CARRYING OUT THE INVENTION

Figure 1:
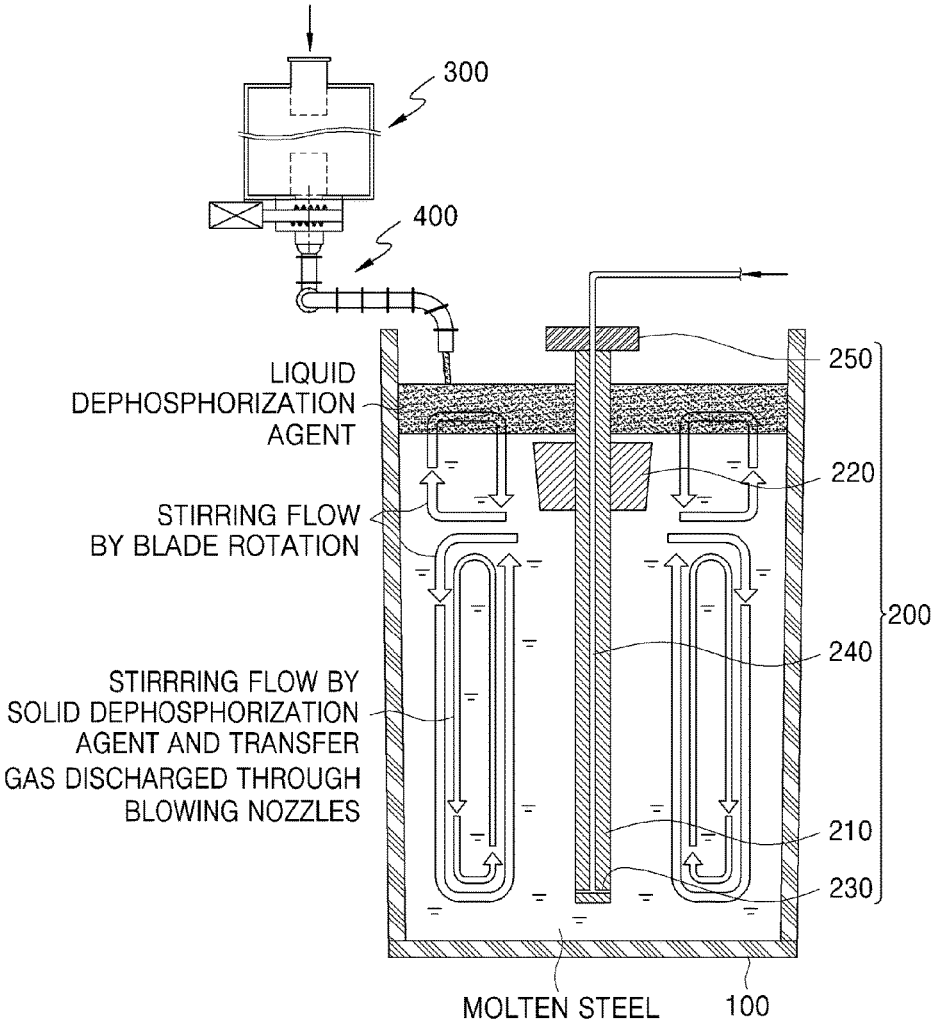
FIG. 1 is a view illustrating a schematic configuration of a molten metal refining device according to an embodiment of the present invention.

Hereinafter, embodiments will be described in more detail with reference to the accompanying drawings. The present disclosure may, however, be in different forms and should not be construed as limited to the embodiments set forth herein. Rather, these embodiments are provided so that this disclosure will be thorough and complete and will fully convey the scope of the present disclosure to those skilled in the art. In the drawings, like reference numerals refer to like elements throughout.

First, the present invention relates to a molten metal refining device and a method thereof which are capable of controlling the concentrations of elements such as sulfur (S) and phosphorus (P) contained in the molten metal by mixing an additive in the molten metal. Hereinafter, a device and a method for controlling the phosphorus (P) concentration contained in molten metal by mixing a dephosphorization agent into the molten metal produced from a electric furnace will be described, but the present invention is not limited thereto, and the concentrations of various elements contained in the molten metal may be controlled by mixing various substances into the molten metal according to operation conditions. That is, in an embodiment of the present invention, in order to control the phosphorus concentration in the molten metal, a liquid dephosphorization agent is introduced from the top portion of the molten metal, a solid dephosphorization agent is inputted into the molten metal, and the molten metal is stirred, so that the dispersion efficiencies of the liquid and solid dephosphorization agents in the molten metal may be improved. Thus, the decrease in the temperature of the molten metal is suppressed to improve the reaction efficiency between the phosphorus component and the dephosphorization agent, so that high-quality molten metal may be obtained.

Hereinafter, the present invention will be described in detail with reference to the accompanying drawings.

FIG. 1 is a view illustrating a schematic configuration of a molten metal refining device according to an embodiment of the present invention.

Referring to FIG. 1, a molten metal refining device according to an embodiment of the present invention includes: an impeller 200 which is disposed movable in the vertical direction over a ladle 100 that receives molten metal and slag and in which a moving path of solid dephosphorization agents is formed; and a liquid dephosphorization agent supply part 300 disposed over the ladle 100 and injecting a liquid dephosphorization agent from the top portion of the molten metal that is charged in the ladle 100. The molten metal refining device may control the phosphorus concentration in the molten metal by stirring the molten metal while supplying the liquid dephosphorization agent to the upper portion of the molten metal charged in the ladle 100 through the liquid dephosphorization agent supply part 300, and supplying the solid dephosphorization agent with a powder state into the molten metal through the impeller.

Figure 2:
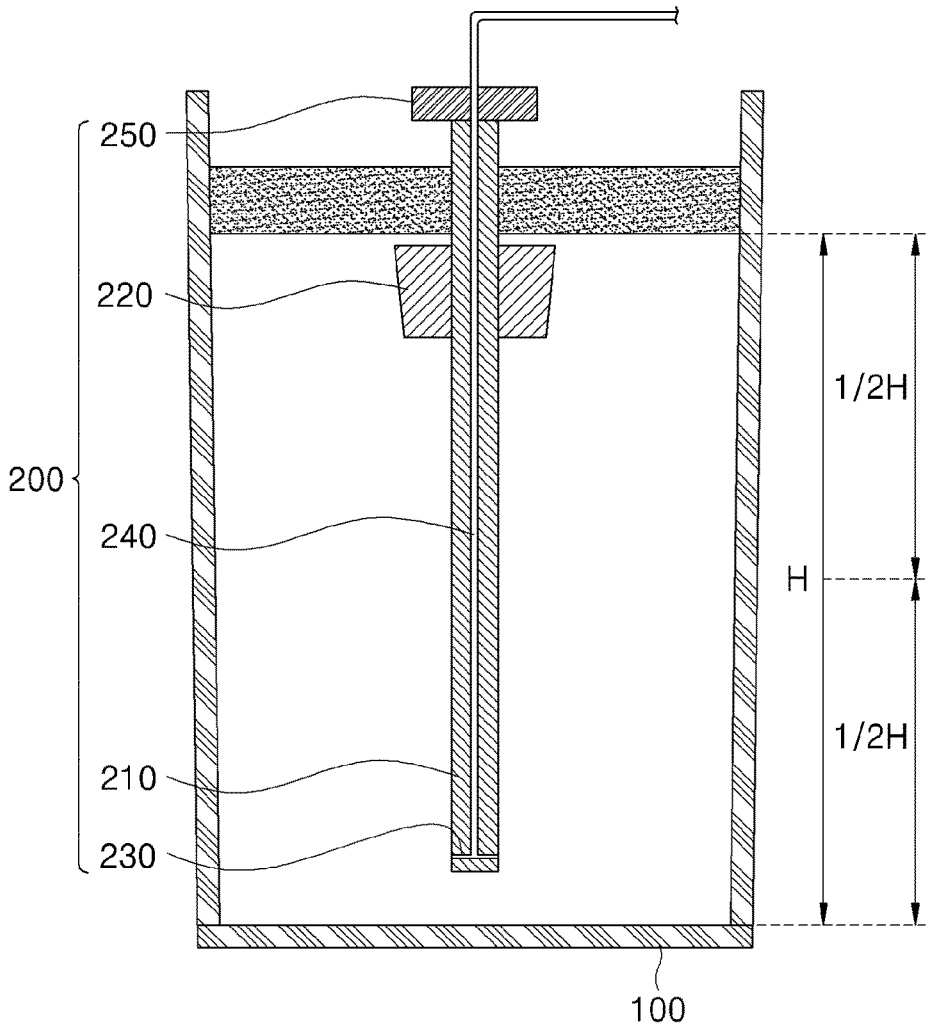
FIG. 2 is a cross-sectional view schematically illustrating a structure of an impeller.
Figure 3:
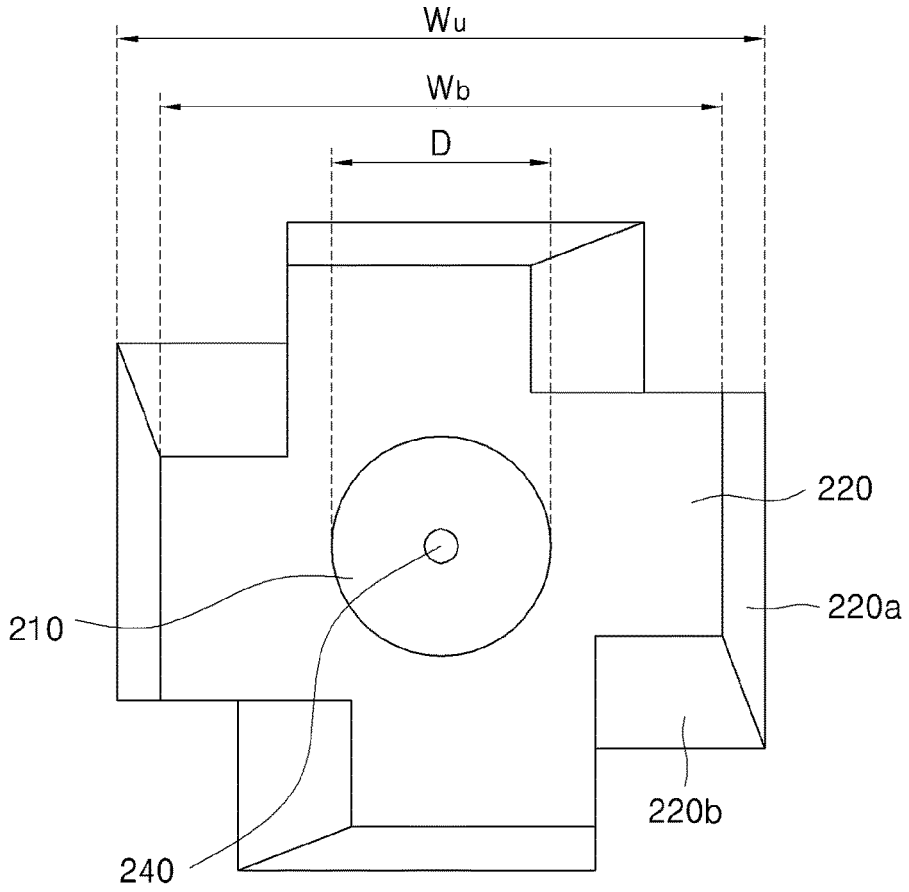
FIG. 3 is a bottom view of a blade.
Figure 4:
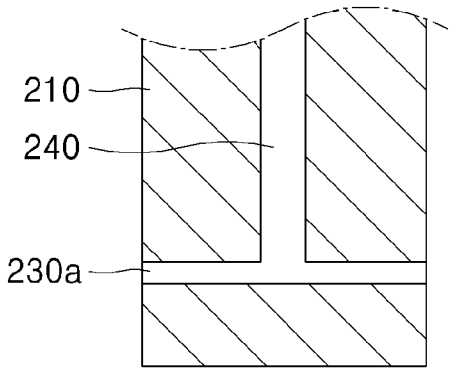
FIG. 4 and FIG. 5 are cross-sectional views illustrating a structure of a blowing nozzle.
Figure 5:
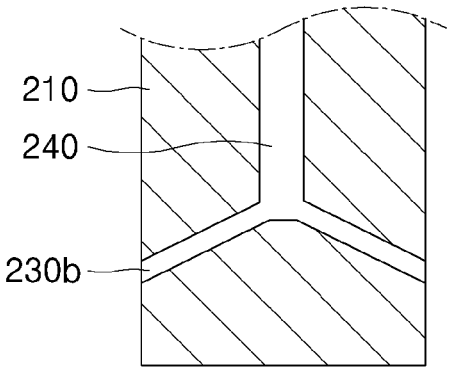

FIG. 2 is a cross-sectional view schematically illustrating a structure of an impeller, FIG. 3 is a bottom view of a blade, and FIG. 4 and FIG. 5 are cross-sectional views illustrating a structure of a blowing nozzle.

Referring to FIG. 2, the impeller 200 is a stirrer which stirs the molten metal received in the ladle 100, and the liquid and solid dephosphorization agents introduced for refining the molten metal. The impeller 200 includes an impeller body 210, a blowing nozzle 230 disposed in the lower portion of the impeller body 210 and blowing the solid dephosphorization agent and transfer gas, and a plurality of blades 220 mounted on the outer circumferential of the impeller body 210. Also, included are: a flange 250 connected to the upper end of the impeller body 210 over the plurality of blades 220, and a supply pipe 240 formed to pass through the inside of the impeller body 210 in the vertical direction and supplying the additives and gas to the blowing nozzle 230. This impeller 200 may be connected to a separate drive part (not shown), for example, a motor, which is installed outside the ladle 100 and provides torque, and favorably connected to the impeller body 210 through the upper portion of the flange 250 of the impeller 200.

The impeller body 210 is a rotational axis or a major axis of the impeller 200, extends in the lengthwise direction or vertical direction, and may extend to be dipped from the surface of the molten metal to at least a lower region of the molten metal. More specifically, the upper end of the impeller body 210 protrudes over slag, and the lower end of the impeller body 210 extends to the lower region of the molten metal, and thus the lower end of the impeller body 210 may be disposed adjacent to the inner bottom surface of the ladle 100. The impeller body 210 according to an embodiment has a rod shape with the lateral cross-section of a circular shape, but the present invention is not limited thereto, and may have any rod shape which has the lateral cross-section with various shapes which are easily rotatable. The flange 250 may be connected to the upper portion of the impeller body 210, and the flange 250 may be connected to the drive part (not shown) providing torque. Accordingly, the impeller body 210 is rotated by the operation of the drive part, and the blades 220 are rotated together by the rotation of the impeller body 210.

The supply pipe 240 communicates with the blowing nozzle 230 disposed in the lower portion of the impeller body 210, and is used as a moving path of the solid dephosphorization agent injected through the blowing nozzle 230. The supply pipe 240 may also be used as a moving path of the transfer gas for moving and injecting the solid dephosphorization agent to the blowing nozzle 230. Also, only the transfer gas is transferred through the supply pipe 240 so as to be injected from the blowing nozzle 230.

The supply pipe 240 is formed to pass through the inside of the flange 250 and impeller body 210 in the vertical direction. The supply pipe 240 according to an embodiment has a hole shape which is formed by machining the inside of the flange 250 and the impeller body 210, but the present invention is not limited thereto, and the supply pipe 240 may have a structure in which a hollow pipe is inserted into the flange 250 and the impeller body 210. The upper end of this supply pipe 240 may be connected to tanks respectively storing the solid dephosphorization agent with a powder state and the transfer gas, and the lower end thereof communicates with the blowing nozzle 230 disposed in the lower portion of the impeller body 210. Here, the internal cross-sectional area of the supply pipe 240 may be formed equal to or nearly similar to that of the blowing nozzle 230 connected to the supply pipe 240. That is, although a plurality of blowing nozzles 230 may communicate with the supply pipe 240, when the cross-sectional area of the supply pipe 240 is too smaller than that of the blowing nozzles 230, the solid dephosphorization agent may not be easily transferred, or the amount of the solid dephosphorization agent discharged through the plurality of blowing nozzle 230 is not enough due to the small transferred amount, and when the cross-sectional area of the supply pipe 240 is too larger than that of the blowing nozzles 230, the solid dephosphorization agent is transferred too much, and thus the solid dephosphorization agent may not be easily discharged through the blowing nozzles 230.

The blowing nozzles 230 blow the solid dephosphorization agent and the transfer gas into the molten metal. The blowing nozzles 230 are disposed in the lower portion of the impeller body 210, and it is effective that the blowing nozzle 230 be spaced maximally apart from the blades 220 disposed in the upper portion of the impeller body 210. Accordingly, in this embodiment, the blowing nozzles 230 are installed adjacent to the inner bottom surface of the ladle 100, and the blades 220 are installed adjacent to the surface of the molten metal. In other words, the blowing nozzles 230 are individually configured separate from the blades 220, and positioned in a lower region of the molten metal received in the ladle 100.

Also, the blowing nozzles 230 are favorably formed in a direction crossing the extension direction (extending in the vertical direction) of the impeller body 210. The blowing nozzles 230 according to the embodiment are formed to extend in the lateral direction of the impeller body 210, and to be branched in a plurality of directions around the supply pipe 240 which passes through the inner central portion of the impeller body 210. The number of the branched blowing nozzles 230 may be the number corresponding to the number of the plurality of blades 220, or may be less than or more than the number of the blades 220. The blowing nozzles 230 according to the embodiment have shapes which are formed by machining the inside of the impeller body 210 and branched in the lateral direction around the supply pipe 240, but the present invention is not limited thereto, and the blowing nozzles 230 may have structures in which thin hollow pipes are inserted into the lower portion of the impeller body 210.

As illustrated in FIG. 4, blowing nozzles 230*a* may be formed in a direction crossing the supply pipe 240, i.e., perpendicular to the supply pipe 240, and may also inject the solid dephosphorization agent to the molten metal in the horizontal direction. Also, as illustrated in FIG. 5, blowing nozzles 230*b* are formed to be downwardly inclined so that the solid dephosphorization agent transferred through the supply pipe 240 may be discharged into the molten metal to be downwardly inclined. Thus, the solid dephosphorization agent discharged from the blowing nozzles 230*b* may be easily dispersed to the lower portion of the molten metal.

Here, the solid dephosphorization agent transferred through the supply pipe 240 and injected through the blowing nozzles 230 is an additive for removing the phosphorus (P) component in the molten metal, and may include at least any one of $BaCO_3$, BaO, $BaF_2$, $BaCl_2$, CaO, $CaF_2$, $Na_2CO_3$, $Li_2CO$ or NaF which has a powder shape. For example, the solid dephosphorization agent may be $BaCO_3$—NaF based. Also, the transfer gas which is transferred through the supply pipe 240 and injected through the blowing nozzles 230 is provided for suppressing or preventing the clogging of the blowing nozzles 230, and may be an inert gas, such as, argon (Ar) or nitrogen ($N_2$), which does not react with the molten metal or the solid dephosphorization agent.

The blades 220 mechanically stir the molten metal charged in the ladle 100 to disperse or spread the liquid dephosphorization agent and the solid dephosphorization agent introduced into the molten metal. These blades 220 are disposed, in an upper portion of the impeller body 210 to be spaced apart from the blowing nozzles 230. That is, the blades 220 are positioned corresponding to an upper region of the molten metal received in the ladle 100 and individually configured separate from the blowing nozzles 230. For example, the upper surfaces of the blades 220 may be disposed adjacent to the surface of the molten metal. These blades 220 are provided in plurality to be connected to the upper outer circumferential surface of the impeller body 210, and the plurality of blades 220 are disposed at equal intervals to be spaced apart from the outer circumferential surface of the impeller body 210. Also, in order to maximize the stirring efficiency, the plurality of blades 220 may be disposed in a shape, for example, a cross shape, with the impeller body 210 disposed therebetween, and may be disposed such that each pair of the blades 220 may face each other approximately the impeller body 210.

Referring to FIG. 3, an upper width Wu of each of the blades 220 may be formed greater than a lower width Wb (Wu>Wb) in order to form the flow of the molten metal from the top of the molten metal to the bottom of the molten metal. Here, the upper width Wu means the length from one side to the other side on the top surface of each of the blades, the lower width Wb means the length from one side to the other side on the bottom surface of each of the blades, and the widths are respectively equal to the diameters of the circles formed at the top portion and the bottom portion of the blades 220 while the blades 220 are rotated. The upper width Wu of each of the blades 220 may be formed greater than the lower width Wb by approximately 5 to approximately 20% of the upper width, and here, the lower width Wb is greater than the diameter D of the impeller body 210. Also, in the blades 220, surfaces 220*a* facing the side connected to the impeller body 210 may be formed to be downwardly inclined. Also, in the blades 220, side surfaces 220*b* facing the adjacent blade may be formed as downwardly inclined surfaces. This implements the effect of pushing down the molten metal when the blades 220 are rotated, so that the molten metal may downwardly flow. Here, the inclined surfaces formed at the side surfaces of the blades 220 may be formed on both sides of the blades 220, but may be formed on only the side surfaces disposed in the rotational direction of the impeller 200. The side surfaces of the blades 220 may form an angle of approximately 10° to approximately 30° with respect to the top surfaces of the blades 220. Also, when the blades 220 is dipped into the molten metal in the ladle 100, the widths of the blades 220 may cover approximately 35% to approximately 45% of the inner diameter of the ladle 100.

Also the heights of the blades 220 may be formed in lengths of approximately 25% to 35% with respect to the upper widths of the blades 220. When the heights of the blades 220 are greater than the suggested range, the contact area between the blades and the molten metal is increased to thereby increase the power consumption for rotating the impeller 200 in comparison with the stirring effect. When the heights of the blades 220 are smaller than the suggested range, there is a limitation in that the stirring efficiency of the molten metal may be decreased.

The blades 220 may be favorably formed to be positioned within 50% from the surface of the molten metal (excluding the liquid dephosphorization agent) when the impeller 200 is dipped into molten metal charged in the ladle 100, and more favorably to be positioned within a range of approximately 10% to approximately 30%. This will be described again in a method for treating the molten metal.

As described above, in the present invention, the blowing nozzles 230 are positioned in the lower region of the molten metal, the blades 220 are separately disposed to be positioned in the upper region of the molten metal, and it is effective that the blades 220 and the blowing nozzles 230 are disposed to be positioned spaced maximally apart from each other. The installation positions of the blowing nozzles 230 and blades 220 according to the embodiment of the present invention will be specifically described as follows. First, for convenience of description, as illustrated in FIG. 2, the depth of the molten metal received in the ladle 100 is referred to as H (the distance from the inner bottom surface of the ladle 100 and the top surface (molten metal surface) of the molten metal). Here, the blowing nozzles 230 are installed to be positioned in the lower region of the molten metal at the depth of less than approximately the midpoint (½H) of the depth H of the molten metal with respect to the inner bottom surface of the ladle 100, and the blades 220 are installed to be positioned in the upper region of the molten metal at the depth of more than approximately the midpoint of the depth H of the molten metal. More favorably, the blowing nozzles 230 are installed to be positioned in the lower region of the molten metal at the depth of less than approximately 3/10 point of the depth H of the molten metal with respect to the inner bottom surface of the ladle 100, and the blades 220 are installed to be positioned in the upper region of the molten metal at the depth of more than approximately 7/10 point of the depth H of the molten metal. When this is described with respect to the surface of the molten metal received in the ladle 100, the blades 220 are positioned in the region within approximately 3/10 point with respect to the molten metal surface (in the direction adjacent to the molten metal surface), and the blowing nozzles 230 are positioned in the region (in the direction adjacent to the bottom surface of the ladle 100) exceeding approximately 7/10 point.

As such, as the blowing nozzles 230 of the impeller 200 are positioned in the lower region of the molten metal, and the blades 220 are positioned in the upper side of the blowing nozzles 230, the stirring efficiency may be improved in comparison with that in the related art.

The liquid dephosphorization agent supply part 300 is provided over the ladle 100 to supply the high-temperature liquid dephosphorization agent to the top portion of the molten metal in the ladle 100. The liquid dephosphorization agent supply part 300 is provided with a melting furnace to melt the solid dephosphorization agent. The liquid dephosphorization agent supply part 300 may be provided with an opening/closing device for supplying or blocking the molten liquid dephosphorization agent and adjusting the supply amount. The opening/closing device may be implemented as various shapes such as a valve, a stopper, or a sliding gate.

Also, a discharge pipe 400 for supplying the liquid dephosphorization agent, which is discharged from the melting furnace, in a high-temperature state to the molten metal may be connected to the liquid dephosphorization agent supply part 300. The discharge pipe 400 may be provided with a heater (not shown) for heating the liquid dephosphorization agent transferred along the inside of the discharge tube 400, and may also be provided with a heat insulation member (not shown) suppressing the temperature decrease of the liquid dephosphorization agent.

As described above, the molten metal refining device according to the embodiment of the present invention stirs the molten metal while supplying a high-temperature liquid dephosphorization agent to the upper portion of the molten metal and discharging the solid dephosphorization agent into the molten metal, and may thus suppress the temperature decrease of the molten metal and quickly and uniformly disperse the dephosphorization agents in the molten metal. Thus, the phosphorus component contained in the molten metal is easily controlled, so that high-quality molten metal may be produced.

Hereinafter, the molten metal refining method according to an embodiment of the present invention will be described.

Figure 6:
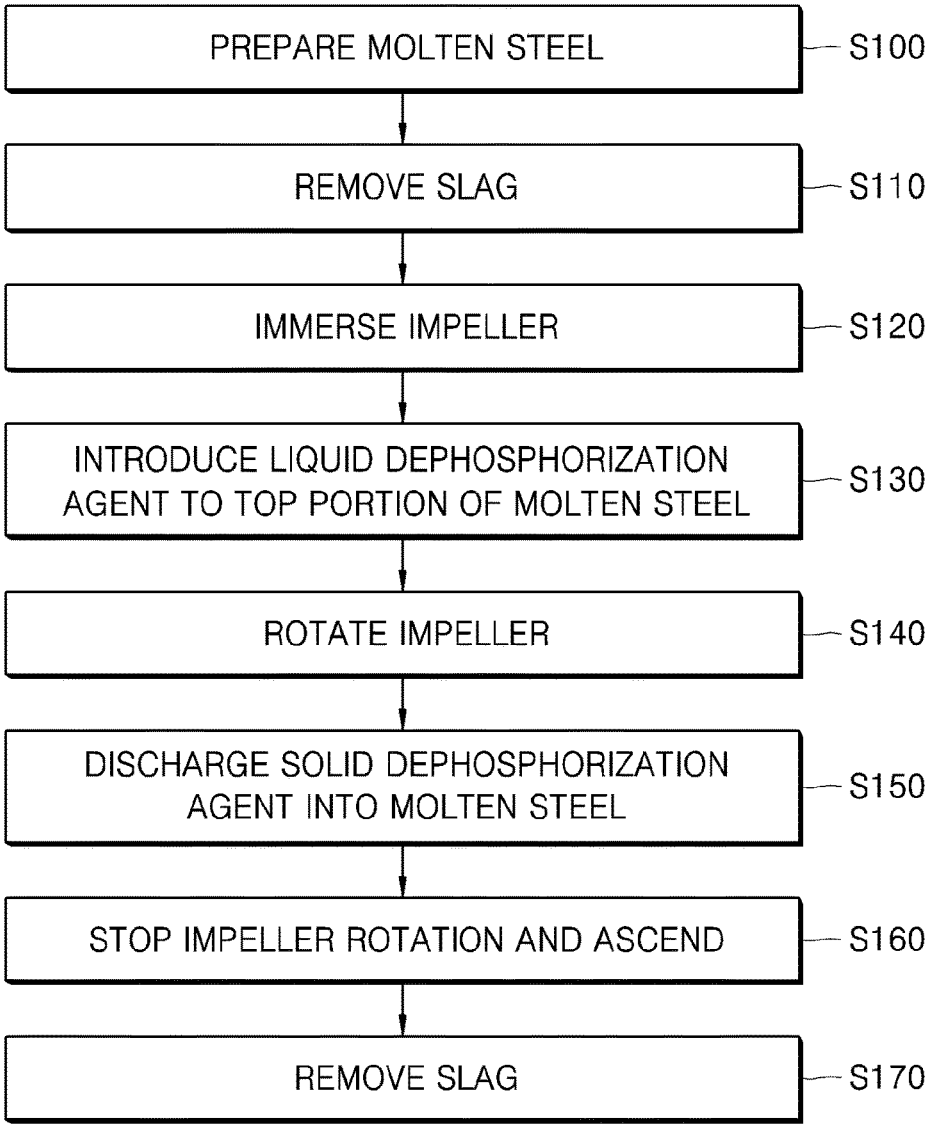
FIG. 6 is a flowchart sequentially illustrating a molten metal refining method according to an embodiment of the present invention.

FIG. 6 is a flowchart sequentially illustrating a molten metal refining method according to an embodiment of the present invention.

First, the ferromanganese molten metal produced from an electrical furnace is tapped to the ladle 100, is then heated by the ladle furnace device, and is then transferred to a workplace for dephosphorization. In the workplace for the dephosphorization, an impeller for stirring the molten metal and a liquid dephosphorization agent supply part 300 for mixing the dephosphorization agent to the molten metal are provided. Here, in the liquid dephosphorization agent supply part 300, the dephosphorization agent which is formed by melting a solid dephosphorization agent may be introduced.

When the molten metal is prepared (S100), slag (LF slag) generated in the process of heating the molten metal is removed (S110).

After removing the slag, the impeller provided over the ladle 100 is lowered to be dipped into the molten metal (S120). Here, to prevent blowing nozzles formed in the lower portion of the impeller from being clogged, a transfer gas is supplied through a supply pipe inside the impeller and is discharged through the blowing nozzles 230.

Next, the liquid dephosphorization agent in the melting furnace is constantly discharged by using an opening/closing device of the liquid dephosphorization supply part 300 and is thereby introduced to the top portion of the molten metal through a discharge pipe 400 (S130). Here, when the liquid dephosphorization agent starts to be introduced to the molten metal, the impeller is rotated to stir the molten metal (S140). Simultaneously, the transfer gas and the solid dephosphorization agent are supplied through a supply pipe 240 of the impeller, and are then discharged into the molten metal through the blowing nozzles (S150).

When introducing the liquid dephosphorization agent, the liquid dephosphorization agent transferred along the discharge pipe 400 is heated so that the temperature decrease of the liquid dephosphorization agent may be suppressed. Thus, the temperature decrease of the molten metal may be suppressed and the dephosphorization efficiency may thereby be improved. Here, the liquid dephosphorization agent may be introduced by an amount of approximately 50% to approximately 70% to the total weight of the dephosphorization agents (solid and liquid dephosphorization agents) which are introduced for the dephosphorization of the molten metal. When the introduced amount of the liquid dephosphorization agent is smaller than the suggested range, a temperature decrease of the molten metal occurs due to the increase in inputted solid dephosphorization agent, and when the introduced amount of the liquid dephosphorization agent is larger than the suggested range, there is a limitation in that although the temperature decrease of the molten metal may be suppressed, the dephosphorization efficiency does not increase any more or minutely increases.

Subsequently, when the stirring of the molten metal by using the rotation of the impeller for a predetermined time is completed, the rotation of the impeller is stopped, the impeller is then raised to be taken out (S160) from the molten metal, and the slag generated in the dephosphorization process is removed (S170). Here, the stirring of the molten metal may be performed for approximately 5 minutes to approximately 20 minutes. When the molten metal is stirred for a time shorter than the suggested time, the dephosphorization effect of the molten metal is decreased, and when the molten metal is stirred for a time longer than the suggested time, the dephosphorization effect of the molten metal is not only decreased, but there is also a limitation in that a separate process for raising the temperature of the dephosphorized molten metal should be performed in a subsequent process.

As such, when the liquid dephosphorization agent is introduced through the upper portion of the molten metal, the solid dephosphorization agent is inputted into the molten metal, and the impeller is simultaneously rotated, the liquid dephosphorization agent is dispersed while being decomposed into minute liquid drops by the rotation of the impeller and being moved from the upper portion to the lower portion of the molten metal, and the solid dephosphorization agent is dispersed while being moved from the lower portion to the upper portion of the molten metal. Also, the blades of the impeller is disposed adjacent to the surface of the molten metal to form the flow of the molten metal in the upper portion of the molten metal, and the blowing nozzles is disposed in the lower portion of the molten metal to form the flow of the molten metal in the lower portion of the molten metal, so that the dispersion efficiency of the liquid and solid dephosphorization agents introduced to the molten metal may be improved.

The flow of the molten metal formed during stirring the molten metal will be described as follows.

When the impeller body 210 is rotated, the blades 220 are rotated together with the impeller body 210. Also, as illustrated in FIG. 1, the stirring flow (solid arrow) generated by the rotation of the blades 220 is generated in the direction toward the inner wall of the ladle 100, collides then with the inner wall, and then flows to be separated upward and downward directions along the inner wall of the ladle 100. Here, since the blades 220 are positioned adjacent to the molten metal surface, the area of the stirring flow of the molten metal in the downward direction from the blades 220 is greater than that of the stirring flow of the molten metal in the upward direction from the blades 220. More specifically, after colliding with the inner wall of the ladle 100, one portion of the molten metal ascends along the inner wall of the ladle 100, then passes thorough the liquid dephosphorization agent on the molten metal surface, then descends along the impeller body 210 and the outer circumferential surface of the blades 220, and then ascends again. Also, the other portion of the molten metal descends in the direction of the lower side of the inner wall of the ladle 100 to an inner lower end portion of the ladle 100, and then ascends again along the outer circumferential surface of the impeller body 210 positioned in a lower side of the blades 220. Accordingly, the liquid dephosphorization agent on the molten metal surface is dispersed while descending along the flow of the molten metal. Here, since both side surfaces of the blades 220, that is, the surface adjacent to the blades 220 is formed to be downwardly inclined and thereby functions to press the molten metal during the rotation of the blades, the downward flow of the molten metal is further accelerated and may thereby accelerate the dispersion of the liquid dephosphorization agent. Also, since having small specific gravities, the solid dephosphorization agent and the transfer gas which are discharged through the blowing nozzles 230 directly ascends along the outer circumferential surface of the impeller body 210, descends while flowing in the direction of the inner wall of the ladle 100 at the upper region of the molten metal by the rotation of the impeller 220, and ascends again along the outer circumferential surface of the impeller body 210 (dotted arrows). Also, the molten metal is also stirred and flows together by this stirring flow of the liquid dephosphorization agent, the solid dephosphorization agent, and the gas. Here, since the flow according to the solid dephosphorization agent and the gas, and the above-mentioned flow according to the blades 220 are the flows in directions corresponding to each other or in the same direction, the flows are integrated with each other to thereby improve the stirring power.

Figure 12:
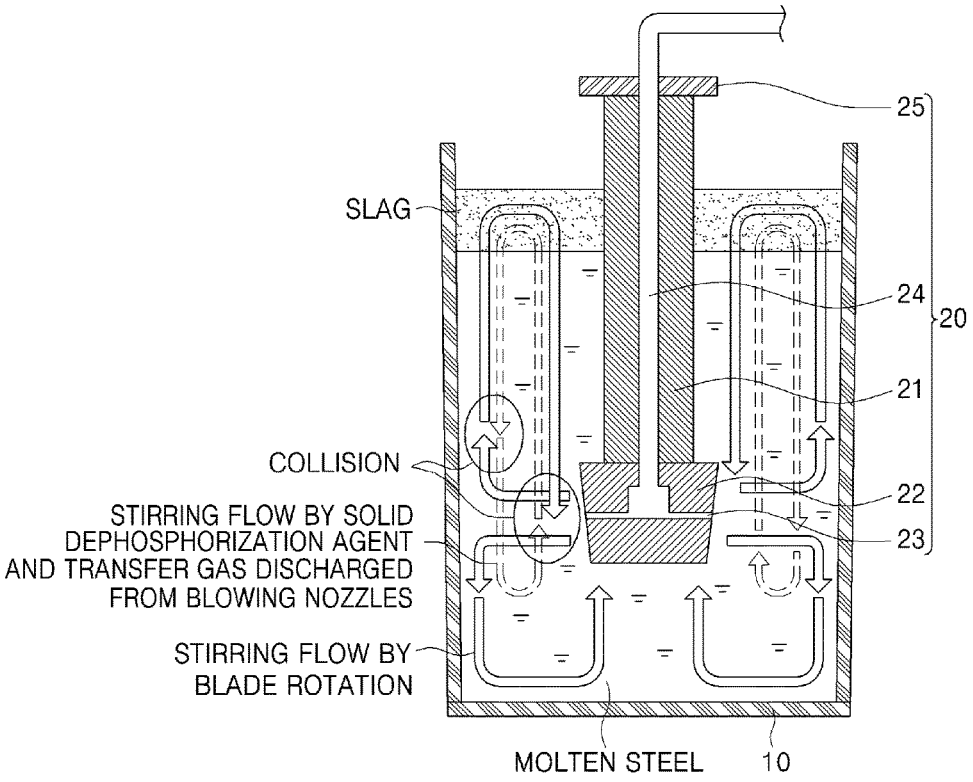
FIG. 12 Prior Art
FIG. 12 is a view illustrating a schematic configuration of a molten metal refining device according to a related art.

Meanwhile, as described in the background art section, a related impeller 20 is provided with a blade 22 in a lower portion of an impeller body 21, and the blade 22 is provided with blowing nozzles 23. That is, in the related impeller 20, the blades 22 and the blowing nozzles 23 are not separated from each other. Here, as illustrated in FIG. 12, the stirring flow (solid arrow) of molten metal generated by the rotation of the blades 22 is generated in the direction toward the inner wall of the ladle 10, collides then with the inner wall, and then flows to be separated in upward and downward directions along the inner wall of the ladle 10. More specifically, after colliding with the inner wall of the ladle 10, one portion of the molten metal ascends along the inner wall of the ladle 10, then passes through slag on the molten metal surface, then descends along the impeller body 21 and the outer circumferential surface of the blades 22, and then ascends again. The other portion of the molten metal descends in the direction of the lower side of the inner wall of the ladle 10 to a inner lower end portion of the ladle 10 and then ascends again. Also, the flows of the dephosphorization agent blown through the blowing nozzles 23 disposed in the blade 22, and the flow of the molten metal by the dephosphorization agent and the gas directly ascend along the outer circumferential surface of the blades 22 and the impeller body 21, pass then through the slag on the molten metal surface, and then descend along the inner wall of the ladle 10. However, a stirring flow generated by the additive and the gas, which are discharged from the blowing nozzle 23, and ascending along the outer circumferences of the blades 22 and the impeller body 21, collides with a flow which collides with the inner wall of the ladle 10 by the rotation of the blades 22, then ascends, and then descends again (the portion indicated by the dotted circle in FIG. 12). Also, the stirring flow according to the dephosphorization agent and the gas, the flow ascending along the outer circumferences of the impeller body 21, and descending then along the inner wall of the ladle 10 collides with the stirring flow which is generated by the rotation of the blades 22, and ascends along the inner wall of the ladle 10 (the portion indicated by the dotted circle in FIG. 12). Also, in the related impeller 20 provided with the blowing nozzles 23 disposed in the blades 22 as in FIG. 12, the above-mentioned collision occurs at a position corresponding to the upper side of the blades 22 or to the blades 22. When the stirring flow according to the additives and gas and the stirring flow according to the rotation of the blades 22 collide with each other, the two flows are cancelled by a mutual action and the total stirring power is consequently decreased. This becomes causes to decrease a reaction ratio and a dephosphorization ratio between the molten metal and the dephosphorization agents in the ladle 10.

Hereinafter, an experiment for optimizing the dephosphorization process to apply the molten metal refining device and the method thereof according to an embodiment of the present invention to an actual operation will be described.

Figure 7:
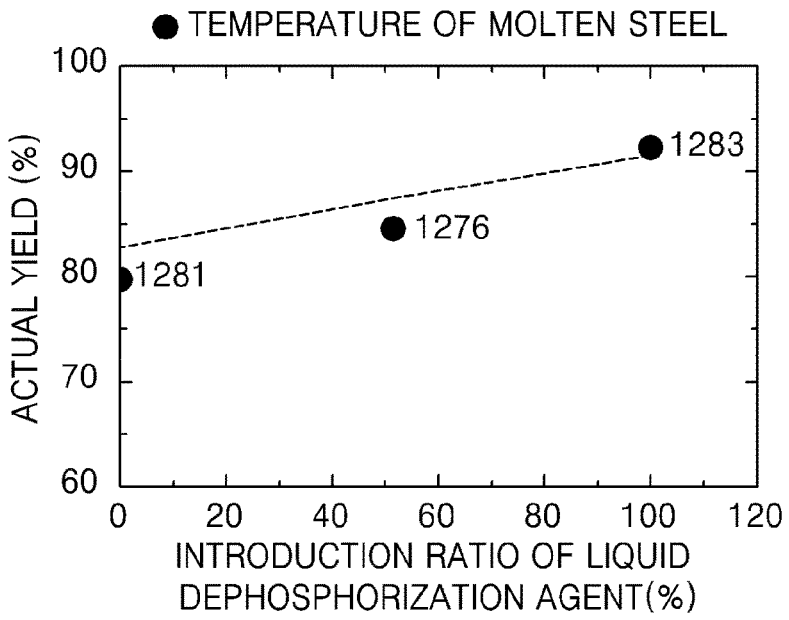
FIG. 7 and FIG. 8 are graphs showing a result of an experimental for optimizing a dephosphorization process by using a molten metal refining device and a method thereof according to an embodiment of the present invention.
Figure 8:
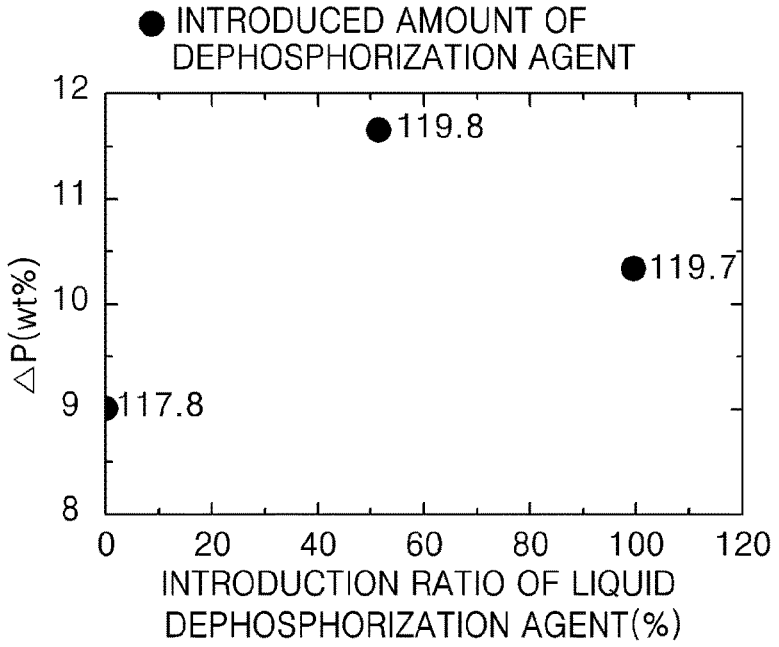

FIG. 7 and FIG. 8 are graphs showing a result of an experiment for optimizing a dephosphorization process by using a molten metal refining device and a method thereof according to an embodiment of the present invention.

To improve the dephosphorization efficiency of molten metal, for example, ferromanganese, a dephosphorization process was performed by using a $BaCO_3$—NaF-based dephosphorization agent. Also, the temperature of the FeMn molten metal, the introduced rate of dephosphorization agents (liquid and solid dephosphorization agents), and the parameters of the introduced ratio of the liquid dephosphorization agent and the dephosphorization efficiency of the ferromanganese molten metal were compared and analyzed after the dephosphorization process.

In the dephosphorization process, the ferromanganese molten metal was prepared by melting approximately 1.7 ton of ferromanganese metal by using a 2.0 ton-class induction furnace. The prepared ferromanganese molten metal was tapped to a preheated ladle 100, the temperature of the molten metal before the dephosphorization treatment was then measured, and then a test specimen (first specimen) was sampled. Here, the temperature of the molten metal before the dephosphorization treatment was measured approximately 1340° C.

Subsequently, while introducing the solid dephosphorization agent having a powder shape and the liquid dephosphorization agent to the molten metal, the molten metal was stirred by using the impeller. The solid dephosphorization agent was inputted into the molten metal through the blowing nozzles of the impeller by using argon gas as transfer gas, and the liquid dephosphorization agent was introduced to the top portion of the molten metal after melting by using an indirect heating-type melting furnace using a carbide (SiC) heat-generating body.

The ladle 100 receiving the dephosphorized molten metal was moved to a sampling place, the temperature of the molten metal after dephosphorization is measured, and a specimen (second specimen) was sampled. Then, the ladle 100 was moved to an iron casting treatment place, and an iron casting treatment was performed by using an iron casting machine, so that the dephosphorization experiment was completed.

Subsequently, components of the sampled specimens were verified through a wet-type analysis by using an inductively coupled plasma spectrometry (ICP) analysis method.

FIG. 7 is a graph showing a temperature relation between an actual yield and the temperature of the molten metal according to the introduced ratio of the liquid dephosphorization agent. It may be understood that as the introduced ratio of the liquid dephosphorization agent increases, the difference between the temperature of the molten metal and the temperature of the molten metal measured before the dephosphorization treatment becomes smaller. That is, it may be understood that the greater the introduced ratio of the liquid dephosphorization agent, the higher the temperature of the molten metal is measured. Also, the tendency in that the greater the introduced ratio of the liquid dephosphorization agent, the greater the actual yield is shown.

For example, when the temperature of the molten metal after the dephosphorization process is approximately 1280° C., it may be understood that the actual yield (approximately 90%) of the molten metal when only the liquid dephosphorization agent is introduced is shown greater than that the actual yield (approximately 80%) of the molten metal when only the solid dephosphorization agent is inputted.

Also, the behavior of the actual yield is very sensitive to the temperature of the molten metal after the dephosphorization process. When the temperature of the molten metal is approximately the early 1280° C.'s, the actual yield of the molten metal is found to be a level of approximately 80% to approximately 90%. However, although not shown, when the temperature of the molten metal is approximately the early 1270° C.'s, which is lower by approximately 10° C., the yield of the molten metal is a level of approximately 65% to approximately 75%, and it is found that the lower the temperature of the molten metal, the lower the actual yield of the molten metal. Accordingly, to improve the actual yield of the molten, the temperatures of the molten metal before and after the dephosphorization process need to be thoroughly managed.

FIG. 8 is a graph showing the dephosphorization efficiency and the rate of introduced dephosphorization agents (liquid and solid dephosphorization agents) according to the introduced ratio of the liquid dephosphorization agent. Here, the dephosphorization efficiency indicates the difference between the concentration Pi of the phosphorus component in the initial molten metal and the concentration Pf of the phosphorus component in the molten metal after the dephosphorization treatment. Referring to the graph, when the introduced ratio of the liquid dephosphorization agent is approximately 0.5 to approximately 0.7, that is, when the liquid dephosphorization agent of approximately 50% to approximately 70% to the total weight of the dephosphorization agents, the dephosphorization efficiency shows the best value, and it may be understood that when the introduced ratio of the liquid dephosphorization agent is increased, the dephosphorization efficiency is decreased. Especially, when comparing the case in which the introduced rate of the dephosphorization agent is 119.8 kg/1 ton (molten metal) with the case in which a similar amount (119.7 kg/1 ton (molten metal)) of dephosphorization agent is introduced, it may be understood that the dephosphorization efficiency shows the best value when the introduced ratio of the liquid dephosphorization agent is approximately 50% to approximately 55%.

Hereinafter, when the molten metal is refined by using a related refining device in which blades and blowing nozzles are formed in a lower portion of an impeller body, an experiment was performed by using a water model to verify the stirring effect. The water model experiment simulates a mass transfer phenomenon between the molten metal and the dephosphorization agent in an actual dephosphorization operation.

First, the water model experiment was performed as follows.

For the experiment, the same amount of water was introduced into a first to sixth containers of the same size, and thymol ($C_{10}H_{14}O$) which had equilibrium distribution ratio to water and oil of approximately 350 or more was introduced into each of the containers and was then dissolved, so that the phosphorus component in the molten metal was simulated. Subsequently, an impeller was dipped in the water, and the water was then rotationally stirred at a constant speed. During stirring, paraffin oil corresponding to the liquid dephosphorization agent was supplied to the top portion of the water. Here, to control the supplying speed of the paraffin oil, a valve for turning on/off the discharge of the paraffin oil and a valve for adjusting the supplying speed were used. The position to which the paraffin oil is supplied was configured as the point of approximately 25% of the radius toward the outer side at the top portion of the container in consideration of the position of the discharge pipe in the actual process.

The blowing nozzles of the impeller did not blow powder but the paraffin oil and nitrogen gas. This experiment is for reviewing the stirring effect of the water and the paraffin oil, and it is sufficient to inject the liquid paraffin oil thorough the blowing nozzles. The paraffin oil was supplied by an amount of 10.8 liters for approximately 10 minutes to simulate the dephosphorization agent rate of approximately 100 kg/ton-FeMn. Also, the rotational speed of the impeller was set approximately 120 rpm, and the flow rate of nitrogen gas which is the transfer gas was applied as approximately 120 liter/min.

To confirm the flow of the water and the paraffin oil, that is, a stirring phenomenon, a video camera was used for imaging, and the water specimen was sampled one time per two minutes at the point approximately 10 mm from the bottoms of first to sixth containers. The stirring continued for approximately 20 minutes, and the experiment was then completed.

The experiment was performed a plurality of times under conditions as described in Table 1 below.

TABLE 1

| | Liquid dephosphorization introduction | Solid dephosphorization Introduction | Blade position (position from molten metal surface) |
|---|---|---|---|
| Experiment example 1 | Introduced | Introduced | 70% |
| Experiment example 2 | Introduced | Introduced | 20% |
| Experiment example 3 | Not introduced | Introduced | 70% |
| Experiment example 4 | Not introduced | Introduced | 20% |
| Experiment example 5 | Introduced | Not introduced | 70% |
| Experiment example 6 | introduced | Not introduced | 20% |

To review the stirring effect according to whether the liquid and solid dephosphorization agents are introduced and the blade position, the experiment was performed while changing the experiment conditions as shown in the above table.

An analysis of thymol in water was performed and interpreted by using mass transfer equations as described below. Here, the total reaction speed becomes the flow speed according to the thymol dispersion speed in the mass transfer resistance layer which exists at the water phase side. This mass transfer equation is given as Equation 1.

$$-\frac{dC_w}{dt} = \frac{K_w A}{V_w}(C_w - C'_w) \quad \text{[Equation 1]}$$

where, Cw is the concentration of thymol in a water phase, and C'w is the concentration of thymol in a mass transfer resistance layer in the water phase side. Kw is a mass transfer coefficient in the water phase, Vw is a volume of the water, and A represents an interface area between the water and oil. In Equation 1, it is assumed that there is no change in a volume in each phase, the interface area is constant, and there is no interface resistance.

The equilibrium distribution ratio β is the same as Equation 2.

$$\beta = \frac{C'_o}{C'_w} = \frac{C_o}{C'_w} \quad \text{[Equation 2]}$$

Here, the reason for C'o=Co is because it is not necessary to consider the mass transfer resistance layer existing at an oil phase due to using the thymol. That is, it is assumed that the concentration of the oil phase is constant.

In consideration of the mass equilibrium of the thymol, Equation 3 may be derived.

$$C_o V_o = (C_w^o - C_w) \cdot V_w \quad \text{[Equation 3]}$$

where, $C_w^o$ is an initial concentration of thymol in the water phase side, and Co and Cw are respectively the thymol concentration of the oil phase side and the thymol concentration of the water phase side at a certain time t.

When the above equations are combined in consideration of the equilibrium at the interface, all concentration terms may be expressed by the Cw term, and may be expressed as the Equation 4 below.

$$\int_{C_w^0}^{C_w} \frac{-dC_w}{C_w\left(1 + \frac{V_w}{\beta V_0}\right) - \frac{V_w}{\beta V_0} C_w^0} = \int_{C_k}^{t} \frac{K_w A}{V_w} t \quad \text{[Equation 4]}$$

Since the equilibrium distribution ratio β has a constant value within the range of the change of the thymol concentration in this experiment, when Equation 4 is integrated, the following Equation 5 is derived.

$$\frac{\ln\left[\left(1 + \frac{V_w}{\beta V_0}\right)\frac{C_w}{C_w^0} - \frac{V_w}{\beta V_0}\right]}{-\left(1 + \frac{V_w}{\beta V_0}\right)} = Y = \frac{K_w A}{V_w} t \quad \text{[Equation 5]}$$

The value of a mass transfer variable KwA may be obtained from the Equation 5, and when the mass transfer variable has a high value, it may be understood that the mass transfer speed becomes faster. That is, it means that the greater the variable KwA, the wider the reaction interface between the molten metal and the dephosphorization agent, and the higher the reactivity by stirring.

Figure 9:
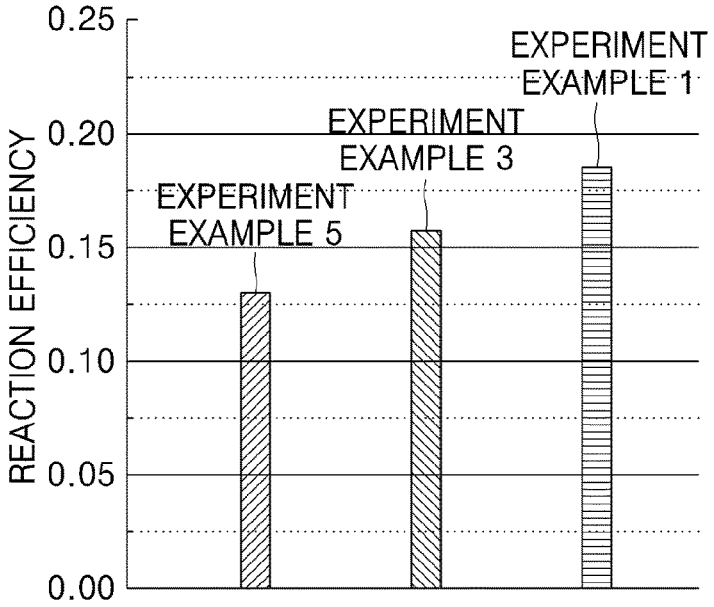
FIG. 9 and FIG. 10 are graphs showing a stirring effect according to a method of introducing a dephosphorization agent and a blade position.
Figure 10:
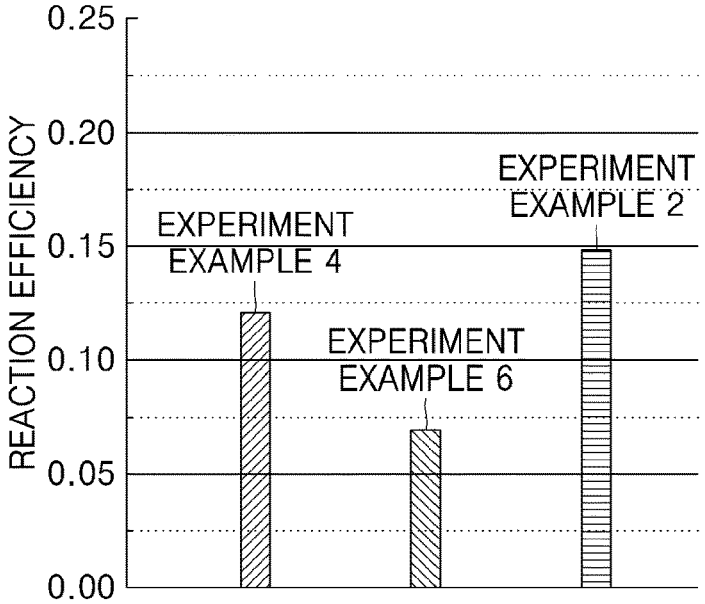

FIG. 9 and FIG. 10 are graphs showing a stirring effect according to a method of introducing dephosphorization agents and a blade position.

First, when the immersion depth of the blade is disposed at a position of approximately 70% from the liquid surface (water surface) as in the first, third, and fifth experiment examples, the value (reaction efficiency) of the term KwA/Vw derived by using the analyzed thymol value was shown in a sequence that first experiment example>third experiment example>fifth experiment example as shown in FIG. 9. That is, when the liquid and solid dephosphorization agents are used together with stirring by the impeller, the stirring effect is shown to be the best.

On the contrary, when the immersion depth of the blade is disposed at a position of approximately 20% from the liquid surface of the water (water surface) as in the fourth experiment example and the sixth experiment example, the value (reaction efficiency) of the term KwA/Vw derived by using the analyzed thymol value was shown in a sequence that second experiment example>sixth experiment example>fourth experiment example as illustrated in FIG. 10. That is, when the liquid and solid dephosphorization agents are used together with stirring the impeller, the stirring effect is shown to be the best, however, when only the solid dephosphorization agent is inputted and the liquid dephosphorization agent is not introduced, the stirring effect is shown to be the worst.

Consequently, it may be said that when the disposition position of the blade is deep, the reaction efficiency of the solid dephosphorization agent supply method is better than that of the liquid dephosphorization agent supply method, and when the disposition position of the blade is shallow, the reaction efficiency of the liquid dephosphorization agent supply method may be better than that of the solid dephosphorization agent supply method. It may be understood that in the method of simultaneously supplying the liquid and solid dephosphorization agents, the reaction efficiency is better than in the case in which only the liquid dephosphorization agent or only the solid dephosphorization agent is used regardless of the disposition position of the blade.

As understood from the result of the water model experiment, in order to easily introduce the liquid dephosphorization agent to be supplied to the top portion of the molten metal, the smaller the immersion depth of the blade, the better. Also, in the method of supplying the solid dephosphorization agent through the blowing nozzle, in order to secure the chance and the time for reaction between the solid dephosphorization agent and the phosphorus component contained in the molten metal, the greater the immersion depth of the blowing nozzle, the better.

Figure 11:
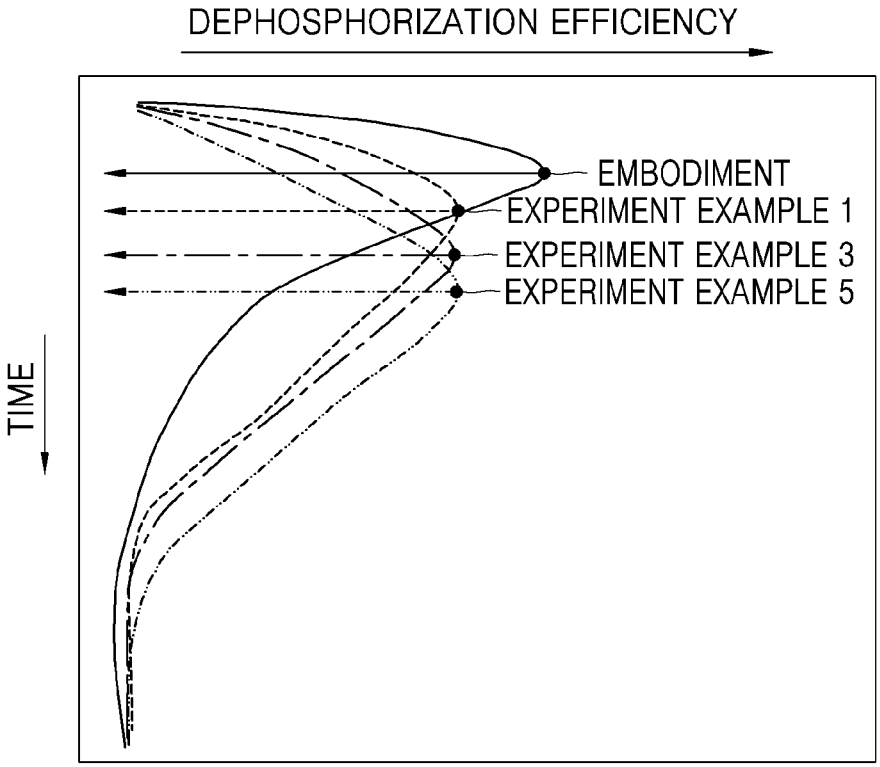
FIG. 11 is graph showing a change in reaction efficiency according to a time for each stirring method.

FIG. 11 is graph showing a change in reaction efficiency according to a time for each stirring method.

Here, the cases in which the molten metal refining devices according to an embodiment of the present invention and according to a related art were compared with each other. The example in which the molten metal refining device according to the related art is the same as the above-described first, third, and fifth experiment examples. Referring to FIG. 11, the dephosphorization reaction efficiency of the molten metal was shown to be the best in the experiment performed through the configuration and method which are nearly the same as those of the embodiment of the present invention.

Also, as shown below in Table 2, when the improved molten metal refining device according to an embodiment of the present invention regardless of the flow rate of the molten metal used for stirring is used, a maximum effective reaction area is reached within a shorter time than in the case in which the molten metal refining device according to a related art. This shows that when the molten metal refining device according to an embodiment of the present invention, the dephosphorization may be performed within a shorter time and the dephosphorization efficiency may be increased through this.

TABLE 2

| | Division | Related art | Present invention |
|---|---|---|---|
| 120 (l/min) | Maximum effective area arrival time (min) | 6 | 3 |
| | Improvement rate (%) | 0 (reference) | 50% |
| 42 (l/min) | Maximum effective area arrival time (min) | 9 | 5 |
| | Improvement rate (%) | 0 (reference) | 44% |

Also, an experiment in which the molten metal was refined under conditions similar to the actual operation on the basis of the water model experiment was performed.

The experiment was performed by using the impeller in which the present invention is applied and the impeller according to a related art. The experiment used the impeller in which the present invention is applied and the impeller according to a related art, and was performed by applying similar dephosphorization agent rates.

TABLE 3

| | Introduced ratio of solid dephosphorization agent (%) | Introduced ratio of liquid dephosphorization agent (%) | Start Temperature (° C.) | Finish Temperature (° C.) | Dephosphorization ratio (%) | Actual yield of iron casting (%) |
|---|---|---|---|---|---|---|
| Related Art | 45.0 | 55.0 | 1379 | 1274 | 66 | 55.7 |
| Present Invention | 42.4 | 57.6 | 1376 | 1306 | 73 | 81.9 |

Referring to Table 3, it may be understood that when nearly similar amounts of dephosphorization flux are supplied, a dephosphorization finishing temperature, a dephosphorization ratio, and an actual yield of iron casting are improved in the case of the present invention in comparison with the related art.

Also, the dephosphorization reaction efficiencies according to the methods of introducing dephosphorization agents were compared with one another. Table 4 shows the results of the dephosphorization process of the molten metal in the cases in which only the solid dephosphorization agent is inputted, only the liquid dephosphorization agent is introduced, and the solid and liquid dephosphorization agents are introduced together.

TABLE 4

| | Phosphorus (P) concentration before dephosphorization (%) | Phosphorus (P) concentration after dephosphorization (%) | ΔT (initial Temperature − finishing Temperature) (° C.) | Dephosphorization ratio (%) |
|---|---|---|---|---|
| Solid dephosphorization agent | 0.134 | 0.049 | 248 | 65 |
| Liquid dephosphorization agent | 0.126 | 0.063 | 76 | 52 |
| Liquid + solid dephosphorization agents | 0.140 | 0.037 | 198 | 78 |

As shown in Table 4, it may be shown that in the case in which the molten metal is dephosphorized by using the solid and the liquid dephosphorization agents are used together, the dephosphorization reaction efficiency is shown to be remarkably higher than in the case in which only the liquid or solid dephosphorization agent is used. In addition, although worse than in the case in which only the liquid dephosphorization agent is used in an aspect of an available temperature range, it is possible to obtain the temperature range wider by approximately 50° C. than in the case in which only the solid dephosphorization agent is used, and thus it may be expected to remarkably contribute to the improvement of the actual yield of molten metal.

Although the present invention has been described with reference to the specific embodiments, it is not limited thereto but limited by following claims. Therefore, it will be readily understood by those skilled in the art that various modifications and changes can be made thereto without departing from the spirit and scope of the present invention defined by the appended claims.

INDUSTRIAL APPLICABILITY

A molten metal refining method and device according to the present invention may improve a dephosphorization efficiency by improving the dispersion performance of dephosphorization agents which are introduced into the molten metal by providing blades and blowing nozzles to be separate from each other, and thus high-quality molten metal may be produced and the reliability of products using the molten metal may be improved.

What is claimed is:

1. A method of refining molten metal, the method comprising:

preparing molten metal;

removing slag from the molten metal;

dipping an impeller into the molten metal;

supplying a liquid dephosphorization agent to an upper portion of the molten metal; and stirring the molten metal by rotating the impeller, wherein a solid dephosphorization agent in a powder state is supplied through a lower portion of the impeller during the stirring of the molten metal, and wherein in the dipping of the impeller, blades of the impeller are disposed above a midpoint of a total depth of the molten metal, and blowing nozzles of the impeller are disposed under the midpoint of the total depth of the molten metal.

2. The method of claim 1, wherein the blades of the impeller are disposed in a region of 10% to 30% from a molten metal surface of the molten metal.

3. The method of claim 1, wherein the stirring comprises: stirring the molten metal such that a direction of a stirring flow of the molten metal generated from blades of the impeller coincides with a direction of a stirring flow of the molten metal generated by the solid dephosphorization agent blown into the molten metal.

4. The method of claim 3, wherein the stirring flow generated from the blades flows to be separated into upward and downward directions, and an area of the stirring flow of the molten metal in the downward direction from the blades is greater than an area of the stirring flow of the molten metal in the upward direction from the blades.

5. The method of claim 1, wherein the liquid dephosphorization agent supplied to the molten metal is 50 wt % to 70 wt % with respect to a total weight of the liquid and solid dephosphorization agents.

6. The method of claim 5, wherein an inert gas is supplied together with the solid dephosphorization agent.

7. The method of claim 6, wherein the slag is removed after the stirring of the molten metal.

8. A method of refining molten metal, the method comprising:

preparing molten metal;

dipping an impeller into the molten metal;

supplying a liquid dephosphorization agent to an upper portion of the molten metal; and stirring the molten metal by rotating the impeller, wherein a solid dephosphorization agent in a powder state is supplied through a lower portion of the impeller during the stirring of the molten metal, and wherein the liquid dephosphorization agent supplied to the molten metal is 50 wt % to 70 wt % with respect to a total weight of the liquid and solid dephosphorization agents.

9. The method of claim 8, wherein an inert gas is supplied together with the solid dephosphorization agent.

10. The method of claim 8, wherein slag is removed after the stirring of the molten metal.

11. The method of claim 8, wherein slag is removed before the dipping of the impeller.

12. The method of claim 8, wherein in the dipping of the impeller, blades of the impeller are disposed above a midpoint of a total depth of the molten metal, and blowing nozzles of the impeller are disposed under the midpoint of the total depth of the molten metal.

13. The method of claim 12, wherein the blades of the impeller are disposed in a region of 10% to 30% from a molten metal surface of the molten metal.

14. The method of claim 8, wherein the stirring comprises: stirring the molten metal such that a direction of a stirring flow of the molten metal generated from blades of the impeller coincides with a direction of a stirring flow of the molten metal generated by the solid dephosphorization agent blown into the molten metal.

15. The method of claim 14, wherein the stirring flow generated from the blades flows to be separated into upward and downward directions, and an area of the stirring flow of the molten metal in the downward direction from the blades is greater than an area of the stirring flow of the molten metal in the upward direction from the blades.

* * * * *